United States Patent [19]

Ayres et al.

[11] 4,034,730

[45] July 12, 1977

[54] CLOSED LOOP CARBURETOR AIR-FUEL RATIO CONTROL APPARATUS

[75] Inventors: John A. Ayres; William H. Holl, both of Flint, Mich.

[73] Assignee: General Motors Corporation, Detroit, Mich.

[21] Appl. No.: 613,314

[22] Filed: Sept. 15, 1975

[51] Int. Cl.[2] ..... F02M 39/00

[52] U.S. Cl. ..... 123/139 AV; 123/119 E; 261/70; 261/27; 261/DIG. 74

[58] Field of Search .... 123/139 R, 139 E, 139 AV, 123/139 AB, 32 EA, 119 E; 261/27, 70, DIG. 74

[56] References Cited

U.S. PATENT DOCUMENTS

| | | | |
|---|---|---|---|
| 3,724,435 | 4/1973 | Bier | 123/139 AV X |
| 3,730,157 | 5/1973 | Gerhold | 261/70 X |
| 3,841,283 | 10/1974 | Wood | 261/DIG. 74 |
| 3,841,613 | 10/1974 | Eckert | 261/DIG. 74 |
| 3,899,552 | 8/1975 | Bauer | 261/DIG. 74 |

*Primary Examiner*—Harold W. Weakley
*Attorney, Agent, or Firm*—Robert M. Sigler

[57] ABSTRACT

In an internal combustion engine with exhaust means and a carburetor including a fuel bowl, means are provided for delivering fuel to the fuel bowl at a pressure varying in response to the output signal of an air-fuel ratio sensor in the exhaust means to maintain a substantially constant air-fuel ratio to the engine. The fuel supply means may comprise, for example, an electric fuel pump whose input power is varied according to the sensor signal.

4 Claims, 5 Drawing Figures

CLOSED LOOP CARBURETOR AIR-FUEL RATIO CONTROL APPARATUS

SUMMARY OF THE INVENTION

This invention relates to the control of air-fuel ratio in engine carburetors and especially to apparatus for providing closed loop control to maintain a constant air-fuel ratio.

It is a common practice, on vehicles with internal combustion engines, to treat the exhaust gases from these engines in catalytic converters to reduce undesirable emissions. It is well known that certain of these catalytic converters are able, when the engine is supplied air and fuel in an approximately stoichiometric ratio, to simultaneously oxidize unburned fuel and reduce oxides of nitrogen with high efficiency. Unfortunately, the efficiency of oxidation deteriorates rapidly as the air-fuel ratio becomes richer than stoichiometric; and the efficiency of reduction deteriorates rapidly as the air-fuel ratio becomes leaner than stoichiometric.

For simultaneous oxidation and reduction in the same converter, therefore, it is necessary to maintain air-fuel ratio to the engine very precisely. Because of the many variables involved in determining air-fuel ratio and the difficulty of controlling them all, closed loop control of air-fuel ratio has been suggested; and systems have been shown which use a feedback signal from an exhaust mounted zirconia sensor or other sensor sensitive to a stoichiometric air-fuel ratio. This signal is processed in electronic circuitry and applied to means for varying the air-fuel ratio in the carburetor. This generally means that the carburetor must be modified in some manner to allow continuous external control of the air-fuel ratio.

It is a feature of this invention, however, that the air-fuel ratio of a carburetor can be continuously externally controlled with no internal modifications that might require retooling by those manufacturing carburetors. Thus, not only is the cost of modification minimized, but the system is capable of addition to existing vehicle engines.

This invention relies on the fact that the air-fuel ratio of a carburetor, for any given mass air flow through the venturi, is affected by the fuel pressure at the fuel bowl inlet. This results from the fact that the pressure on fuel entering the air stream in the venturi from the nozzle in the fuel passage is dependent on the surface level of the fuel in the fuel bowl, which is set by the float valve mechanism in a manner affected by the pressure of fuel on the float valve. It has been found by the inventors that variation of the fuel pressure by such means as, for example, varying the input power to an electric fuel pump or opening and closing a variable restriction in the fuel line, does so change the engine air-fuel ratio that it is a practical and effective means for completing a feedback control system to maintain a substantially constant air-fuel ratio.

Further details and advantages of this invention will be apparent from the accompanying drawings and following description of a preferred embodiment.

DESCRIPTION OF THE PREFERRED EMBODIMENT

Figure 1:
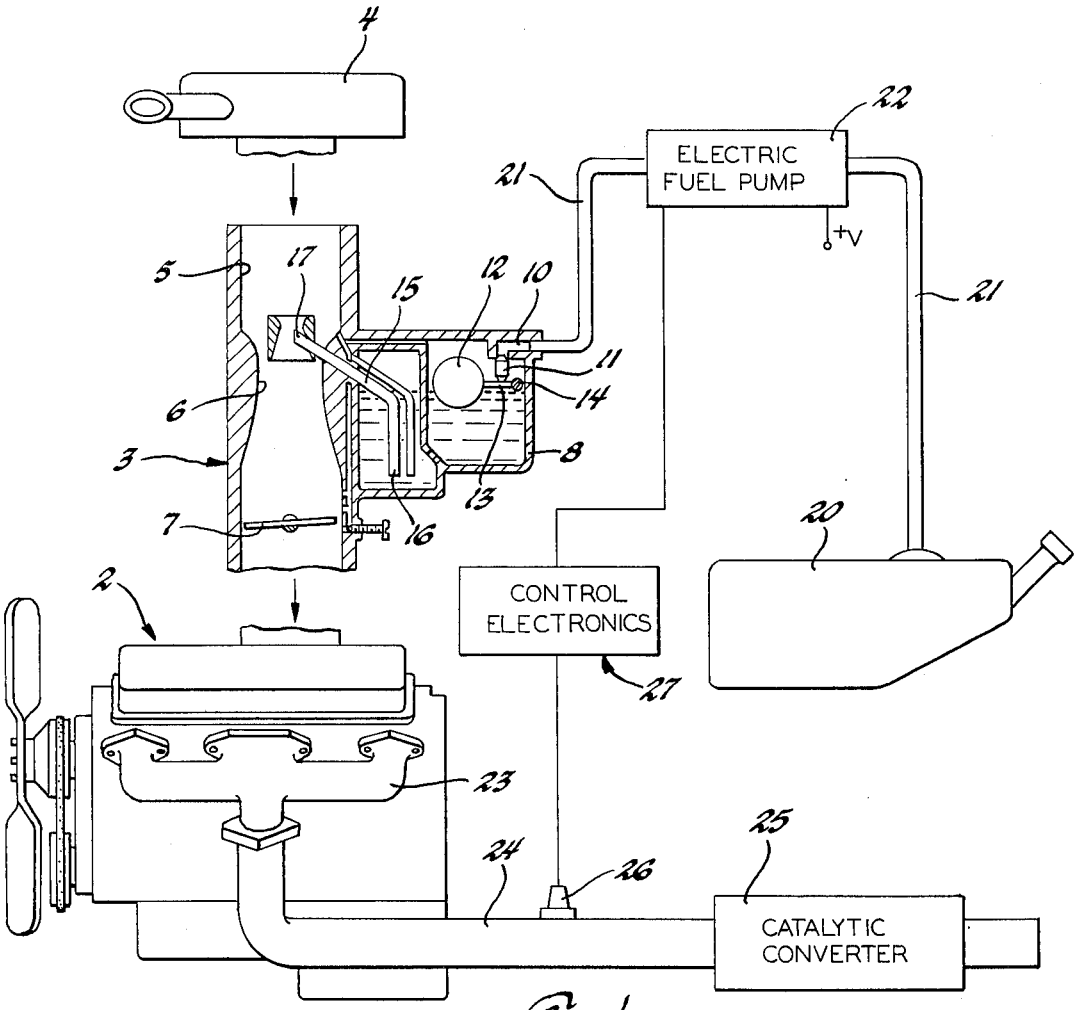
FIG. 1 shows a preferred embodiment of this invention.

Referring to FIG. 1, an engine 2 is supplied with fuel and air in a controlled ratio by a carburetor 3. Air from the atmosphere is provided to the carburetor 3 through an air cleaner 4 and is drawn through an induction passage 5 with a venturi 6 in carburetor 3 by engine vacuum in engine 2, the rate of flow being controlled by a throttle valve 7.

Carburetor 3 further includes a fuel bowl 8 which receives fuel through an inlet 10, the flow through which is controlled by a valve 11 connected to a float mechanism comprising a float 12 on one end of an arm 13, the other end of which arm is pivoted at 14. Valve 11 follows the vertical movement of float 12, closing inlet 10 to reduce the flow therethrough as float 12 moves upward and opening inlet 10 to increase the flow therethrough as float 12 moves downward.

Carburetor 3 further includes a fuel passage 15 having a lower end 16 near the bottom of fuel bowl 8 and an upper end 17 forming a fuel nozzle projecting into venturi 6. By means of fuel passage 15, fuel is drawn from fuel bowl 8 into venturi 6, where it is atomized and mixed with the air flowing through air passage 5 on its way to engine 2.

A standard fuel tank 20 is provided for the storage of liquid fuel, which is pumped to fuel bowl inlet 10 through conduit means 21 by an electric fuel pump 22. The input power to pump 22 determines the pump output pressure and therefore the fuel pressure at the fuel bowl inlet 10, which pressure is applied to valve 11.

Engine 2 includes an exhaust manifold 23 and an exhaust conduit 24 leading to a catalytic converter 25. An exhaust sensor 26, exposed to the gases in exhaust conduit 24, generates an output signal having a steep, smooth slope as the engine air-fuel ratio passes through stoichiometry. A typical example of such a sensor is a zirconia sensor as described in the U.S. Pat. No. 3,844,920 issued to Richard R. Burgett and Bruce W. Holleboom on Oct. 29, 1974. The output signal from sensor 26 is provided to an electric control circuit 27, which generates an output current in accordance with the signal for the operation of fuel pump 22.

Figure 2:
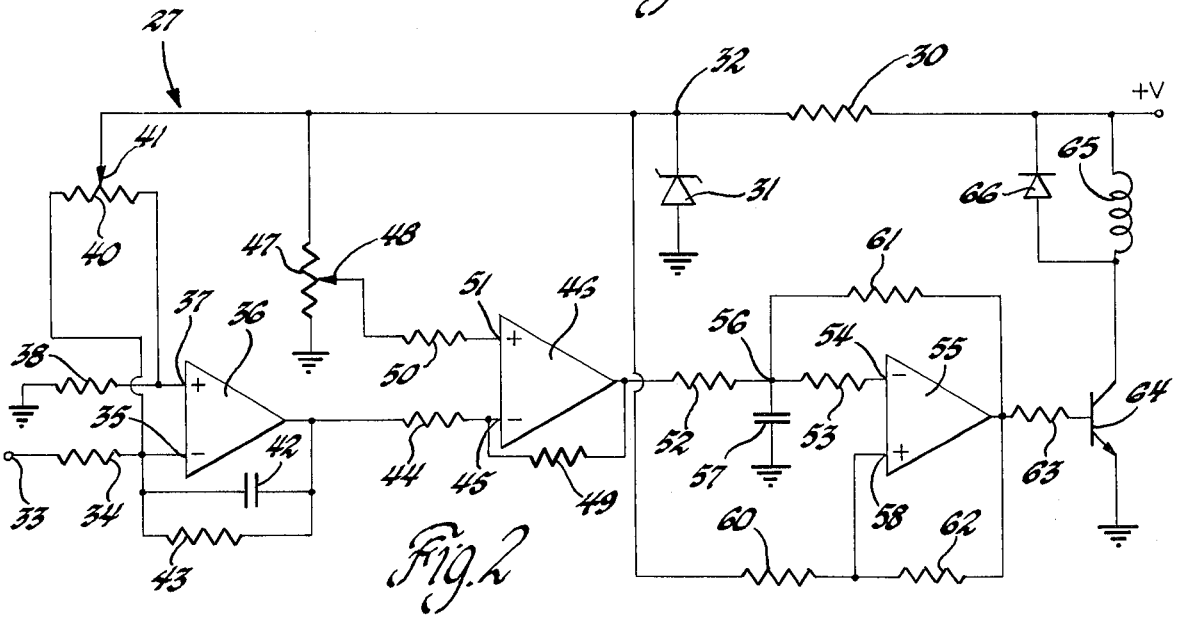
FIG. 2 shows a feedback control circuit for use in the system of FIG. 1.

Control circuit 27 is one example of a control circuit suitable for this invention. It is designed to be powered by a low voltage DC power supply such as the typical vehicle-mounted storage battery, alternator and voltage regulator. The positive terminal of this power supply, denoted as +V in FIGS. 1 and 2, is connected through a resistor 30 and zener diode 31 to ground. The junction 32 of the anode of the zener diode 31 and resistor 30 is thus maintained at a regulated voltage determined by the voltage drop across zener diode 31. This junction 32 is the source of bias for the operational amplifiers to be enumerated below.

The signal from sensor 26 is applied to a terminal 33 connected through a resistor 34 to the negative input 35 of an operational amplifier 36. Operational amplifier 36 and those other operational amplifiers enumerated below are Norton current- mode operational amplifiers in this embodiment. The positive input 37 of amplifier 36 is connected through a resistor 38 to ground and another resistor 40 to negative input 35. A variable tap 41 of resistor 40 is connected to junction 32.

The output of operational amplifier 36 is connected back through a capacitor 42 and parallel resistor 43 to negative input 35 and also through a resistor 44 to the negative input 45 of an operational amplifier 46. A resistor 47 is connected between junction 32 and ground; and a variable tap 48 of resistor 47 is connected through a resistor 50 to the positive input 51 of amplifier 46.

The output of operational amplifier 46 is connected through a resistor 49 to negative input 45 and through a resistor 52 and another resistor 53 in series to the negative input 54 of an operational amplifier 55. The junction 56 of resistors 52 and 53 is connected through a capacitor 57 to ground. The positive input 58 of amplifier 55 is connected through a resistor 60 to junction 32.

The output of amplifier 55 is connected through a resistor 61 to junction 56, through a resistor 62 to positive input 58 and through a resistor 63 to the base of a power transistor 64. Transistor 64 has a grounded emitter and a collector connected through an inductive coil 65 and parallel back-biased diode 66 to power source +V.

Inductive coil 65 is the electromagnetic element which converts the electric signal to a mechanical force in whatever means are to be used to control the fuel pressure at inlet 10. In this embodiment, coil 65 represents the armature winding of a permanent magnet electric motor used to drive electric fuel pump 22. In an embodiment using a valve or restriction, coil 65 would represent an electromagnetic solenoid element controlling the position or state of such valve or restriction. The common property of all such devices represented by coil 65 is that they create a mechanical force proportional to the current through coil 65; and the mechanical force is used in some way to vary the fuel pressure.

The operation of circuit 27 will now be described. The output signal from sensor 26 and a number of constant reference voltages are applied to amplifier 36 through resistors 34, 38 and 40. Feedback capacitor 42 causes amplifier 36 to operate as an integrator; and feedback resistor 43 causes amplifier 36 to operate as a proportional amplifier. The result is that a combined proportional and time integral signal is applied to amplifier 46, where it is summed with a reference provided through resistors 47 and 50.

Amplifier 55, together with resistors 53, 60, 61 and 62 and capacitor 57, comprises an oscillator with a square wave output. The application of a varying signal from amplifier 46 through resistor 52 to junction 56 results in a variable duty cycle operation of the oscillator: the proportion of high output voltage to low output voltage varies with the voltage signal applied to junction 56. The output of this oscillator is applied through resistor 63 to power transistor 64 to turn transistor 64 on and off in accordance with the variable duty cycle. The current through coil 65 is thus varied in accordance with the same duty cycle; and the mechanical inertia or ballast provided in the controlled device effectively averages the variable duty cycle signal. In the case of an electric fuel pump 22, the rotational inertia of the armature renders the armature unable to follow the high frequency square wave of the signal precisely; and the fuel pump thus turns at a speed determined by the average power input from the signal. Diode 66 is a standard protection device for voltage transients to protect transistor 64 as it switches.

The operation of the entire system will now be described. It is well known in the art of carburetor design that the rate of fuel flow through fuel passage 15 from fuel bowl 8 to venturi 6 is determined by the pressure in venturi 6 and the difference in height between the upper end 17 of air passage 15 and the level of fuel within fuel bowl 8. Assuming unchanging atmospheric pressure, for any given mass flow rate of air through venturi 6 the pressure at nozzle 17 will be constant and less than atmospheric pressure; and the rate at which fuel is added to the constant flowing air will vary with the fuel level in fuel bowl 8.

Still assuming a constant mass flow rate of air through venturi 6, and further assuming a constant fuel pressure at the inlet 10 of fuel bowl 8, the float mechanism comprising float 12, arm 13 and valve 11 will maintain a constant fuel level in fuel bowl 8 by balancing the upward buoyant force on float 12 against the downward forces of gravity on the entire mechanism and fuel pressure on valve 11. If the fuel pressure on valve 11 increases, fuel flows through inlet 10 into fuel bowl 8 at a faster rate until the fuel level in fuel bowl 8 rises to a new equilibrium level. At the new higher fuel level, however, the rate of fuel flow through fuel passage 15 is increased somewhat and the mixture delivered to engine 2 is thus enriched. The opposite actions occur if the fuel pressure at inlet 10 is reduced, leading to a leaner air-fuel ratio in the mixture delivered to engine 2.

The general phenomenon of air-fuel ratio changing with changing fuel level in a fuel bowl has been noticed in the past by others familiar with the carburetor art; however, it has generally been considered a problem to be overcome in carburetor design. In this invention, though, the signal from sensor 26 is processed through circuit 27 to control the rate at which energy is supplied to electric fuel pump 22 and thus vary the fuel pressure at inlet 10 to change air-fuel ratio in the desired direction. For example, if sensor 26 is exposed to a mixture richer than stoichiometric, it generates a high voltage output signal which causes fuel pump 22 to decrease its pumping speed and reduce the fuel pressure at inlet 10. Fuel level in fuel bowl 8 consequently falls and causes a leaner mixture to be supplied to engine 2. Similarly, a signal from sensor 26 corresponding to a mixture leaner than stoichiometric causes the pumping speed of fuel pump 22 to increase, the fuel level in fuel bowl 8 to rise and the mixture supplied to engine 2 to increase in richness. The monitoring of air-fuel ratio by sensor 26, and thus the correction in air-fuel ratio within carburetor 3, is continuous, thus providing close control of the actual air-fuel ratio over time. It should be noted that, because of the output characteristics of the zirconia sensor, the desired constant air-fuel ratio can be maintained somewhat to the rich or lean side of stoichiometric, perhaps by a few tenths of an air-fuel ratio unit, by proper selection of the reference voltages within circuit 27. Thus the optimum air-fuel ratio can be selected within a few tenths of an air-fuel ratio unit on either side of stoichiometric.

Figure 3:
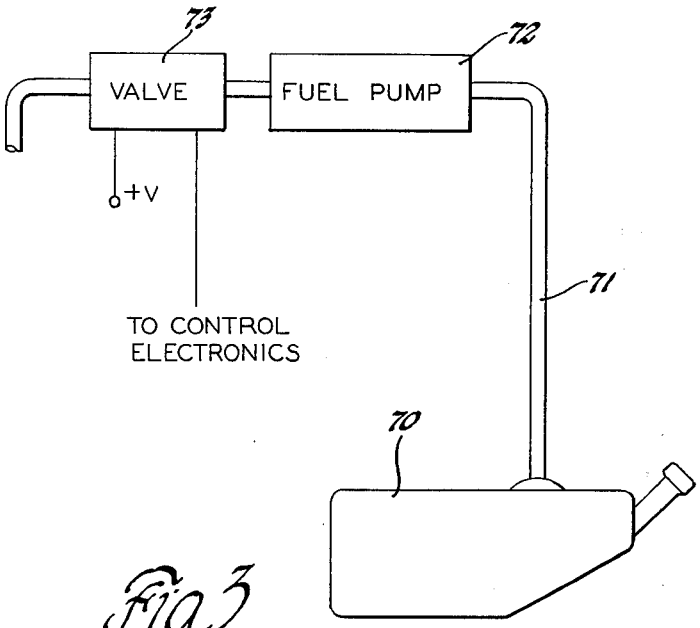
FIG. 3 shows a portion of an alternate embodiment of this invention.

Referring to FIG. 3, a slightly different embodiment of the invention is described. Fuel is pumped from a fuel tank 70 through a conduit 71 by a fuel pump 72, which is not constrained in design or motive power but can be any pump suitable for pumping fuel. On the downstream side of pump 72, between pump 72 and the inlet 10 to the fuel bowl 8, shown in FIG. 1, is inserted a variable restriction or valve 73 having a flow area therethrough controlled by coil 65 in FIG. 2. The pressure of fuel at inlet 10 is controlled in this embodiment by valve 73 according to the signal from sensor 26 and circuit 27.

Figure 4:
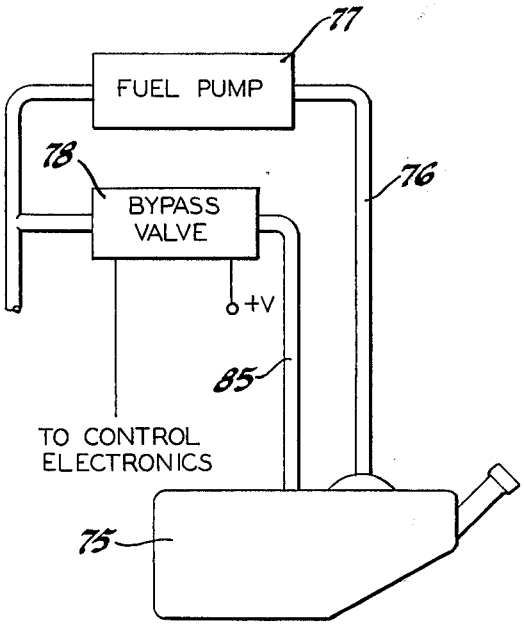
FIG. 4 shows a portion of an alternate embodiment of this invention.

Another embodiment of this invention is shown in FIG. 4. Fuel from a tank 75 is pumped through a conduit 76 by a fuel pump 77 to inlet 10 of fuel bowl 8 in FIG. 1. A bypass valve 78, actuated by coil 65 of circuit 27 in FIG. 2, controls the amount of fuel bled back to tank 75 through a conduit 85 to vary the fuel pressure at inlet 10 in FIG. 1.

Figure 5:
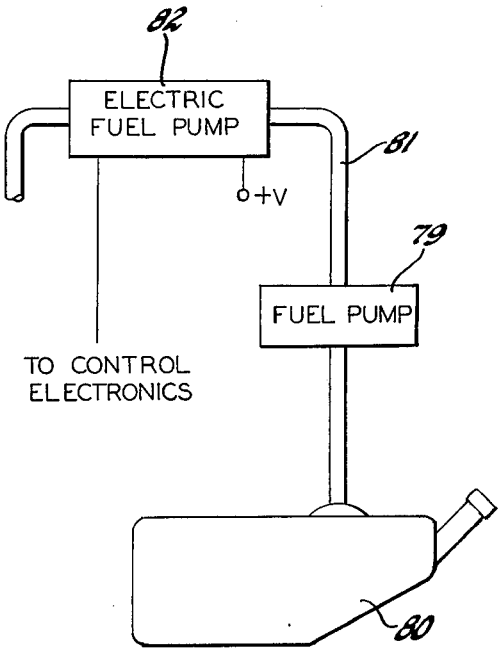
FIG. 5 shows a portion of an alternate embodiment of this invention.

FIG. 5 shows a further embodiment of this invention in which a primary fuel pump 79 pumps fuel from a fuel tank 80 through a conduit 81 to inlet 10 in FIG. 1. In series with pump 79 in conduit 81 is an electric fuel pump 82 controlled by the signal from sensor 26 to vary the fuel pressure at the fuel bowl inlet 10 in FIG. 1.

It is noted that any of fuel pumps 22, 72, 77, 79 or 82 could be located within their respective fuel tanks.

The embodiments described herein are preferred but not the only embodiments of this invention that will occur to those skilled in the art. Therefore, this invention should be limited only by the claims which follow.

The embodiments of the invention in which an exclusive property or privilege is claimed are defined as follows:

1. Apparatus for supplying air and fuel to an internal combustion engine in a predetermined ratio, comprising:

a carburetor having a fuel bowl and defining an air passage into the engine, the carburetor further defining a fuel passage from the fuel bowl to the air passage by which fuel passage fuel is added to the air in the air passage for delivery to the engine, the rate of fuel flow through the fuel passage and hence the air-fuel ratio of the resulting air-fuel mixture being a function of the fuel level in the fuel bowl;

a float mechanism in the fuel bowl effective to sense the fuel level in the fuel bowl;

valve elements associated with the float mechanism and responsive thereto to pass fuel delivered thereto into the fuel bowl at rates tending to maintain, at a given delivered fuel pressure, a constant fuel level therein, the valve elements further being responsive to changing delivered fuel pressure to vary the constant fuel level;

a fuel reservoir;

fuel pump means effective to deliver fuel from the fuel reservoir to the valve elements at a pressure varying in response to a signal, whereby varying the signal alters the fuel level in the fuel bowl and thus the air-fuel ratio of the engine;

sensor means in the engine exhaust stream effective to generate a signal indicative of the ratio of air to fuel supplied to the engine, and means responsive to the sensor means to apply the signal to the fuel pump means in feedback control to continuously vary the fuel pressure in a direction to reduce the deviation of the engine air-fuel ratio from the predetermined ratio, whereby the engine air-fuel ratio is maintained at substantially the predetermined ratio.

2. Apparatus according to claim 1 wherein the fuel pump means comprises an electric fuel pump effective to generate a fuel pressure at the valve elements as a function of the electric power applied thereto; and the signal applying means is effective to vary the electric power supplied to the electric fuel pump in response to the signal.

3. Apparatus according to claim 1 in which the fuel pump means comprises a fuel pump effective to supply fuel to the valve elements through a variable restriction; and the signal applying means is effective to vary the variable restriction, and thus the fuel pressure at the valve elements, in response to the signal.

4. Apparatus according to claim 1 wherein the fuel pump means comprises a fuel pump being effective to deliver fuel to the valve elements through a conduit and bleed fuel from the conduit through a variable restriction; and the signal applying means is effective to vary the variable restriction in response to the signal.

* * * * *